United States Patent [19]

Iai et al.

[11] Patent Number: 4,915,799

[45] Date of Patent: Apr. 10, 1990

[54] ELECTROLYTIC COLORING METHOD FOR CHROMIUM ALLOY

[75] Inventors: Hideki Iai; Katsuaki Shimouchi; Yoshikazu Aoki, all of Yao, Japan

[73] Assignee: Kinki Yakuhin Industrial Co., Ltd., Yao, Japan

[21] Appl. No.: 16,430

[22] Filed: Feb. 19, 1987

[30] Foreign Application Priority Data

| | | | |
|---|---|---|---|
| Feb. 21, 1986 | [JP] | Japan | 61-37989 |
| Feb. 21, 1986 | [JP] | Japan | 61-37990 |
| Feb. 21, 1986 | [JP] | Japan | 61-37991 |
| May 15, 1986 | [JP] | Japan | 61-111860 |
| May 19, 1986 | [JP] | Japan | 61-114293 |

[51] Int. Cl.[4] ..... C25D 5/44

[52] U.S. Cl. ..... 204/35.1; 204/56.1; 204/34; 204/38.1; 204/41

[58] Field of Search ..... 204/35.1, 34, 38.1, 204/56.1, 140, 41, DIG. 9; 148/6.2

[56] References Cited

U.S. PATENT DOCUMENTS

| | | | |
|---|---|---|---|
| 3,755,117 | 8/1973 | Hart | 204/38.1 |
| 4,026,737 | 5/1977 | Takahari et al. | 148/6.2 |
| 4,127,450 | 11/1978 | Azzerri et al. | 204/34 |
| 4,137,132 | 1/1979 | Ward et al. | 204/38.1 |
| 4,370,210 | 1/1983 | Yoshihara et al. | 204/140 |
| 4,490,184 | 12/1984 | Forcht et al. | 148/6.2 |

FOREIGN PATENT DOCUMENTS

| | | | |
|---|---|---|---|
| 0004440 | 1/1977 | Japan . | |
| 0070948 | 6/1977 | Japan . | |
| 0016328 | 2/1978 | Japan . | |
| 115395 | 9/1982 | Japan . | |
| 0002696 | 1/1985 | Japan . | |
| 61-03229 | 6/1986 | Japan | 204/56.1 |

*Primary Examiner*—John F. Niebling
*Assistant Examiner*—Steven P. Marqus
*Attorney, Agent, or Firm*—Armstrong, Nikaido, Marmelstein, Kubovcik & Murray

[57] ABSTRACT

In this electrolytic coloring method for chromium alloy, first, an aqueous solution containing, for example, chromic acid of 250 g/l as a main material and, for example, sulfuric acid of 490 g/l as an electrolyte is prepared. Then, in this aqueous solution, chromium alloy, for example, a stainless steel plate undergoes an anode electrolytic treatment and a cathod electrolytic treatment respectively for one or more seconds with a current having an average current density of 0.05–2 $A/dm^2$ respectively one or more in an alternatingly repeated manner, and thereby an oxide film is formed on the surface of the chromium alloy. In this case, the color tone of the oxide film formed on the chromium alloy is adjusted by varying the respective average current densities, the respective treating times and the numbers of repetition cycles of the anode electrolytic treatment and the cathode electrolytic treatment.

26 Claims, 6 Drawing Sheets

ELECTROLYTIC COLORING METHOD FOR CHROMIUM ALLOY

BACKGROUND OF THE INVENTION

1 Field of the Invention

The present invention relates to an electrolytic coloring method for chromium alloy, and specifically relates to an electrolytic coloring method for chromium alloy which colors the surface of chromium alloy, for example, stainless steel by applying electrolytic treatments thereto.

2 Description of the Prior Art

The conventional electrolytic coloring method for chromium alloy is disclosed, for example, in the Japanese Patent Publication No 32621/1977. This method is such that stainless steel as a chromium alloy is immersed in an aqueous solution containing chromic acid and sulfuric acid, and the stainless steel undergoes an anode electrolytic treatment to form a porous oxide film on the stainless steel, and thereby the surface of the stainless steel is colored.

Also, this inventor proposed an electrolytic coloring method for chromium alloy which can adjust the color tone of an oxide film to be formed based on the current density and the treating time of the anode electrolytic treatment in such a conventional electrolytic coloring method for chromium alloy.

In the conventional electrolytic coloring method and in the electrolytic coloring method proposed by this inventor, with the lapse of treating time of the anode electrolytic treatment, the color tone of the oxide film to be formed varies sharply, and therefore adjustment of the color tone is difficult and reproducibility of the color tone is worse.

SUMMARY OF THE INVENTION

Therefore, the principal object of the present invention is to provide an electrolytic coloring method for chromium alloy which can simply adjust the color tone of the oxide film formed on the surface of chromium alloy.

The present invention is of an electrolytic coloring method for chromium alloy which colors chromium alloy by applying an electrolytic treatment to this chromium alloy, and comprises a process for preparing an aqueous solution containing chromic compound as a main material and sulfuric acid and a process for forming an oxide film on the surface of the chromium alloy by applying an anode electrolytic treatment and a cathode electrolytic treatment respectively for one or more seconds with a current having an average current density of 0.05–2A/dm$^2$ respectively one or more times in an alternating repeated manner, and in the process for forming the oxide film on the surface of the chromium alloy, the color tone of the oxide film is adjusted by varying the average current densities, the treating times and the numbers of repetition cycles of the respective anode electrolytic treatment and cathode electrolytic treatment.

In the process for forming the oxide film on the surface of chromium alloy, the color tone of the oxide film to be formed is adjusted by varying the average current densities, the treating times and the numbers of repetition cycles of the respective anode electrolytic treatment and cathode electrolytic treatment.

In accordance with the present invention, the color tone of the oxide film formed on the surface of chromium alloy can be simple adjusted.

Furthermore, when the cathode electrolytic treatment is applied to the chromium alloy whereon the oxide film is formed in the aqueous solution with a current which has an average current density value larger than that in the cathode electrolytic treatment in the process for forming the oxide film and is 0.5–5A/dm$^2$, the oxide film formed on the surface of the chromium alloy is hardened, and thereby the strength of the oxide film can be improved. In this case, the aqueous solution for forming the oxide film on the surface of the chromium alloy and the aqueous solution for hardening the formed oxide film are the same aqueous solution, and therefore the color tone of the oxide film can be adjusted in the aqueous solution in one bath, and the strength of the oxide film can be improved.

These objects and other objects, features, aspects and advantages of the present invention will become more apparent from the following detailed description of the embodiments of the present invention when taken in conjunction with accompanying drawings.

BRIEF DESCRIPTION OF THE DRAWINGS

FIG. 1A is an illustrative view of the whole thereof, and FIG. 1B is an illustrative view showing a bath and the peripheral portion thereof.

DESCRIPTION OF THE PREFERRED EMBODIMENTS

Embodiment 1

Figure 1A:
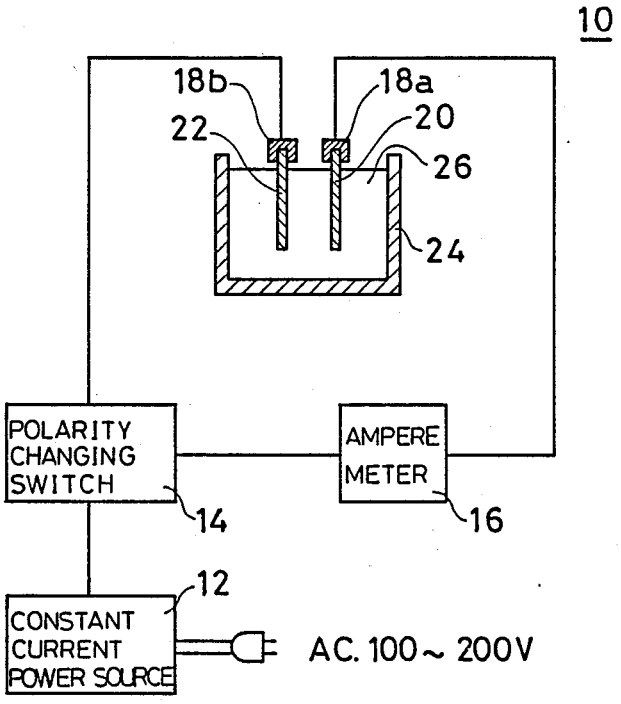
FIG. 1A and FIG. 1B are views showing one example of an apparatus for practicing the present invention.
Figure 1B:
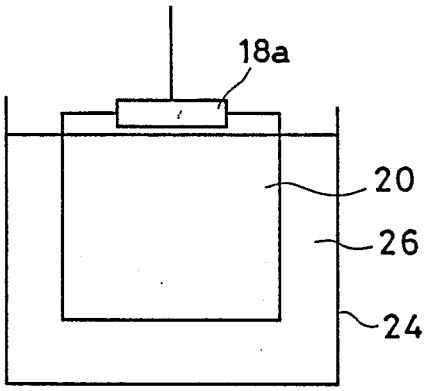

FIG. 1A and FIG. 1B show one example of an apparatus for embodying the present invention, and FIG. 1A is an illustrative view showing the whole thereof, and FIG. 1B is an illustrative view showing a bath and the peripheral portion thereof.

This apparatus 10 comprises a constant current power source 12. This constant current power source 12 outputs an arbitrary constant current from the output terminal thereof by connecting, for example, an AC power source of 100V to 200V or more to the input terminal thereof. In addition, this constant current power source 12 can output a DC constant current of an arbitrary current value, for example, 0 -10.0A, and can carry a current having a current density of, for example, 0-10.0A/dm$^2$ through a conductor having a current passing area of, for example, 1dm$^2$.

The output terminal of the constant current power source 12 is connected to the input terminal of a polarity changing switch 14. This polarity changing switch 14 changes-over the polarity of the current inputted to the input terminal thereof intact or after an arbitrary lapse of time, and outputs a current from the output terminal thereof.

Figure 2A:
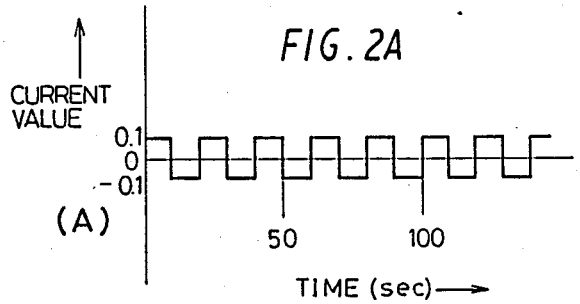
FIG. 2A through FIG. 2D and FIG. 3 are graphs showing examples of output currents of a polarity changing switch in the case where a constant current is inputted to the polarity changing switch.
Figure 2B:
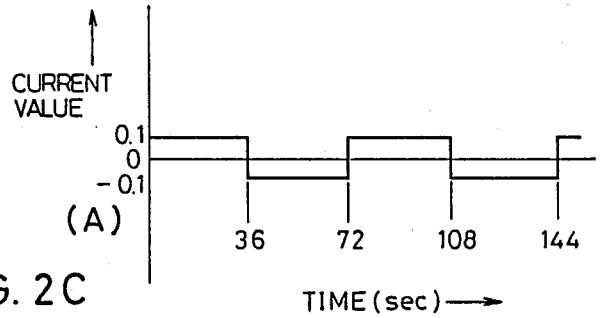
Figure 2C:
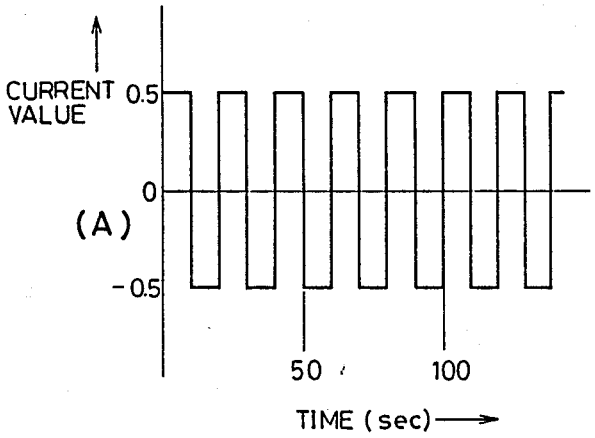
Figure 2D:
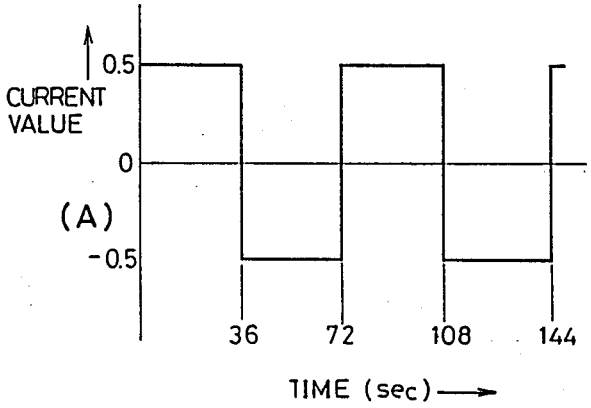
Figure 3:
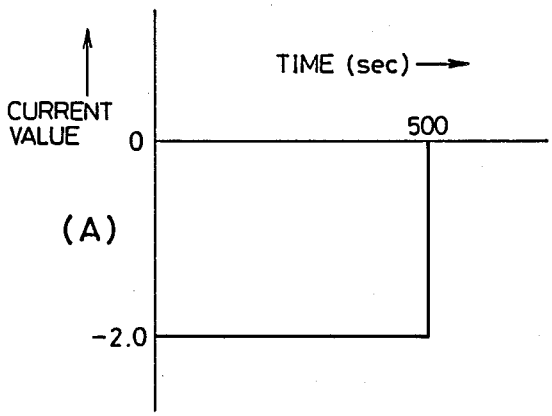

Accordingly, the constant current inputted to the input terminal of this polarity changing switch 14 is outputted, for example, as a current whose polarity is changed-over after a lapse of arbitrary time as shown in FIG. 2A through FIG. 2D or as a current whose polarity is constant as shown in FIG. 3. In addition, FIG. 2A and FIG. 2B show relationships between time and current value in the case where the current value of the constant current inputted to the polarity changing switch is 0.1A, and FIG. 2C and FIG. 2D show relationships between time and current value in the case where the current value of the constant current inputted to the polarity changing switch is 0.5A, and further, FIG. 2A and FIG. 2C show relationships between time and current value in the case where the polarity of the constant current is changed-over every 10 seconds, and FIG. 2B and FIG. 2D show relationships between time and current value in the case where the polarity of the constant current is changed-over every 36 seconds. Also, FIG. 3 shows a relationship between time and current value in the case where the current value of the constant current inputted to the polarity changing switch is 2.0A and the time is 500 seconds.

One of the output terminals of the polarity changing switch 14 is connected to a plate 20 to be colored, for example, through an ampere meter 16 of digital display or analog display and a copper connector 18*a*. For this plate 20 to be colored, for example, chromium alloy, for example, AISI 304 stainless steel or AISI 430 stainless steel is used.

In addition, this plate 20 to be colored preferably undergoes, for example, a degreasing treatment, a water rinsing treatment and a neutralizing treatment as a pretreatment for the electrolytic coloring treatment. This degreasing treatment is performed by immersing the plate 20 to be colored such as a stainless steel plate as chromium alloy, for example, in a sodium orthosilicate family solution, for example, at 70° C. Also, the water rinsing treatment is performed by rinsing the plate 20 to be colored in a water bath using an ultrasonic cleaner. Furthermore, the neutralizing treatment is performed by immersing the plate 20 to be colored, for example, in a solution of 20% $HNO_3$ for 30-60 seconds.

On the other hand, the other output terminal of the polarity changing switch 14 is connected to a counter electrode plate 22 as a counter electrode of the plate 20 to be colored, through a copper connector 18*b*. This counter electrode plate 22 is formed of lead in this embodiment, but may be formed of another conductive metal such as platinum, titanium, niobium, carbon, nickel or stainless steel.

The plate 20 to be colored and counter electrode plate 22 are disposed in an aqueous solution 26 in a bath 24 so as to face each other with a predetermined interval kept.

Also, the aqueous solution 26 stored in the bath 24 contains, for example, chromic acid of 250 g/l as a main material and sulfuric acid of 490 g/l as an electrolyte.

Furthermore, as a preferred example of the aqueous solution 26 in the present invention, an aqueous solution containing chromic acis of 50-500 g/l and sulfuric acid of 300-1000 g/l is named.

This means that when chromic acid contained in the aqueous solution is less than 50 g/l, the process for forming the oxide film takes too much time to be of practical use, and when exceeding 500 g/l, chromic acid is hard to solve, resulting in an economical disadvantage, and therefore it is preferable that chromic acid contained in the aqueous solution 26 in the present invention is within the above-mentioned range.

Furthermore, when sulfuric acid contained in the aqueous solution is less than 300 g/l, reaction of the electrolytic treatment is too slow to be put in practical use, and when exceeding 1000 g/l, the surface of the plate to be colored is solved and a porous oxide film cannot be formed on the surface of the plate to be colored, and therefore sulfuric acid contained in the aqueous solution in the present invention is preferably within the above-described range.

Furthermore, preferably, an aqueous solution containing chromic acid of 200-400 g/l and sulfuric acid of 400-600 g/l is named.

In addition, for the main material of the aqueous solution 26, chromic compound, for example, chromate or bichromate acid can be utilized in place of chromium acid.

Also, the aqueous solution 26 may contain metal ions, for example of Cr, Mn, Mo, Mg, Ni, Sn, Co, V, Ti, Al, B, W, Ir, and Zr. In this case, the wear resistance of the oxide film to be formed is improved. Also, particularly in the case where metal ions $Ni^{2+}$ of Ni or metal ions $Mo^{6+}$ of Mo are contained in the aqueous solution 26, the time taken for forming the oxide film is shortened.

Then, in the present invention, the oxide film is formed on the surface of chromium alloy by applying the anode electrolytic treatment and the cathode electrolytic treatment to the chromium alloy (the plate 20 to be colored) for example, stainless steel respectively for one or more seconds with a current having an average current density value of 0.05-2A/dm$^2$ respectively once or more in an alternatingly repeated manner in the aqueous solution 26 containing the above-described main material, sulfuric acid and the like. In this case, the color tone of the oxide film to be formed is adjusted by varying the average values of current density, the treating times and the numbers of repetition cycles of the respective anode electrolytic treatment and cathode electrolytic treatment for forming the oxide film.

Embodiment 2

The oxide film formed in the embodiment 1 has a weak strength, and is peeled off when brought in contact with another object.

In this embodiment 2, in order to improve the strength of the oxide film by hardening, the cathode electrolytic treatment is applied to the plate 20 to be colored with a current which has a current density larger than that in the cathode electrolytic treatment in the process for forming the oxide film in the aqueous solution 26 of the embodiment 1 and is 0.5-5A/dm$^2$. By this cathode electrolytic treatment, the oxide film is hardened and the strength thereof is improved.

Conventionally, for the method of hardening the oxide film, for example, as disclosed in the Japanese Patent Publication No. 31817/1978 and the Japanese Patent Publication No. 24040/1981, there is a method wherein a cathode electrolytic treatment is applied to chromium alloy whereon an oxide film is formed in an aqueous solution containing sulfuric acid having a concentration which is low compared with that of sulfuric acid used for coloring and chromic acid, and thereby the oxide film is hardened. Furthermore, conventionally, for the method of hardening the oxide film, for example, as disclosed in the Japanese Patent Publication No. 46476/1980, there is another method wherein chromium alloy whereon an oxide film is formed undergoes a cathode electrolytic treatment in a aqueous solution containing chromic acid and phosphoric acid, and thereby the oxide film is hardened. However, in such conventional methods, in order to form an oxide film on the surface of chromium alloy and further harden the oxide film, at least two kinds of aqueous solutions are required; an aqueous solution for forming an oxide film and an aqueous solution for hardening the oxide film. This means that two or more baths are required to store aqueous solutions, and therefore the work is very troublesome.

On the other hand, in accordance with this embodiment 2, an oxide film can be formed on the surface of chromium alloy and further the oxide film can be hardened in one kind of aqueous solution 26 containing chromic acid of 50–500 g/l and sulfuric acid of 300–1,000 g/l. Therefore, an oxide film can be formed on the surface of chromium alloy and the oxide film can be hardened using one bath.

In addition, when the oxide film is hardened in an aqueous solution further containing metal ions, for example, $Mg^{2+}$, $Sn^{2+}$ or $Sn^{4+}$ of 20 g/l sliding on the oxide film is improved, and a finger print or the like is hard to adhere to the surface of the oxide film and the contamination resistance of the oxide film is improved.

Embodiment 3

Figure 4:
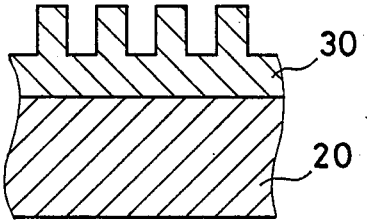
FIG. 4 is an illustrative view showing the state of forming an oxide film on the surface of a plate to be colored by embodying the present invention.
Figure 5:
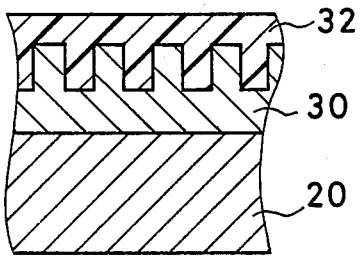
FIG. 5 is an illustrative view showing the state of forming a paint layer on the surface of the oxide film as shown in FIG. 4.

In the above-described embodiments 1 and 2, as illustrated in FIG. 4, an oxide film 30 is formed in a shape exposed to the surface of the plate 20 to be colored, and therefore these embodiments have deficiencies of poor wear resistance and poor corrosion resistance of the oxide film In this embodiment 3, in order to solve these deficiencies, as illustrated in FIG. 5, a paint, for example, acrylurethane resin is coated on the surface of the oxide film 30 using a coating apparatus, for example, a flow coater, and thereby a paint layer 32 is formed on the surface. For the material of this paint layer 32, an organic family paint, for example, melanin resin, epoxy resin, phenol family resin, urethane resin, fluorine family resin or silicon family resin or an inorganic paint, for example, silicone may be used in addition to acrylurethane resin, and a paint wherein these paints and pigments are mixed may be used. Thus, for forming the paint layer 32 on the surface of the oxide film 30, the wear resistance and the corrosion resistance of the oxide film 30 are improved.

In addition, the paint layer may be formed in a manner that a solution of metal alkoxide is coated on the surface of the oxide film by a coating apparatus, for example, a flow coater, and the solution of metal alkoxide is heated, for example, to 200° C.–500° C. In this case, for the solution of metal alkoxide, a solution containing metal alkoxide can be utilized wherein hydroxyl groups of alcohol, for example, ethylalcohol are substituted with metal, for example, silicon or tin.

Figure 6:
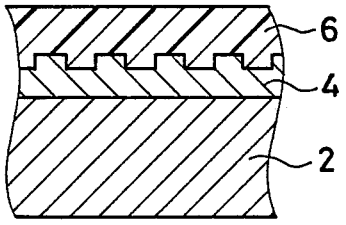
FIG. 6 is an illustrative view showing one example of the conventional painted stainless steel.
Figure 7:
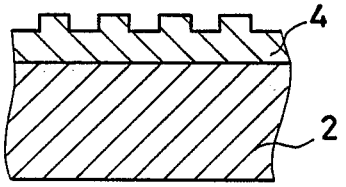
FIG. 7 is an illustrative view showing the state of forming the oxide film on the surface of the plate to be colored by the conventional method.

One example of the conventional painted stainless steel whose wear resistance and corrosion resistance are thus improved is disclosed, for example, in the Japanese Patent Provisional Publication No. 56841/1974. FIG. 6 is an illustrative view showing one example of such a conventional painted stainless steel. This painted stainless steel 1 comprises a plate 2 to be colored composed of chromium alloy, for example, stainless steel, and as illustrated in FIG. 7, an oxide film 4 is formed on the surface of this plate 2 to be colored, for example, by an immersion coloring method. Furthermore, a paint layer 6 is formed on the surface of this oxide film 4 by coating a paint, for example, a synthetic resin. However, in such a conventional painted stainless steel 1, the paint layer 6 thereof is likely to come off. This reason is presumed to be that even when a method of forming a porous hard oxide film excelling in the wear resistance such as the immersion coloring method is employed, the thickness of the oxide film 4 to be formed is as very thin as several microns at a maximum, and the surface area of the oxide film 4 cannot be made so large even if it is porous. Consequently, it is presumed that even when the paint layer 6 is formed on the surface of the oxide film 4 by coating a paint such as resin, the contact area of the oxide film 4 with the paint layer 6 is not so large.

On the other hand, in accordance with this embodiment 3, as illustrated in FIG. 4, the oxide film 30 is formed thicker and the holes thereof are formed deeper in comparison with the porous hard oxide film 4 (FIG. 6) formed by the conventional immersion coloring method or the like. For this reason, it is presumed that in this embodiment 3, the contact area of the oxide film 30 with the paint layer 32 becomes larger and the surface of the oxide film 30 is activated in comparison with the conventional one, and actually, the adhesion of the paint layer 32 to the oxide film 30 can be improved.

In addition, the following degreasing treatment may be applied to the plate 20 to be colored in place of the pretreatment as exemplified in the above-described embodiment 1.

This degreasing treatment is such that first a degreasing solution is prepared which contains at least one kind selected from among a group consisting of chromium compound, manganese compound, vanadium compound, and selenium compound as a main material and contains sulfuric acid, the plate 20 to be colored undergoes a cathode electrolytic treatment, and the degreasing treatment is applied to the surface of the plate 20 to be colored. In this case, for the chromic compound as the main material of the degreasing solution, for example, chromium acid, chromate or bichromic acid can be utilized.

Also, as a preferred example of this degreasing solution, a solution containing potassium permanganate of 5–100 g/l and sulfuric acid of 50–1000 g/l is named. This means that when potassium permanganate contained in the degreasing solution is less than 5 g/l, the process for degreasing the surface of chromium alloy takes too much time to be put in practical use, and when it exceeds 100 g/l, it is hard to be wholly saved, and therefore this case has not only an economical disadvantage but also a danger of explosion which is presumably caused by manganese heptoxide, and therefore potassium permanganate contained in this degreasing solution is preferably within the above-described range. Futhermore, if sulfuric acid contained in the degreasing solution is less than 50 g/l, reaction of the electrolytic treatment is too slow to be put in practical use, and if it exceeds 1000 g/l, it is hard to be wholly saved resulting in an economical disadvantage, and therefore sulfuric acid contained in this degreasing solution is preferably within the above-described range. Also, for the main material of the degreasing solution, in addition to $KMnO_4$ (potassium permanganate), for example, $NaMnO_4$ (sodium permanganate), $MnO_2$ (manganese dioxide), $MnSO_4$ (Manganese sulfate), MnO, $Mn_3O_4$, $Mn_2O_3$, $MnO_3$, $Mn_2O_7$,$MnAl_2O_4$,$MnTiO_3$,$LaMnO_3$,$K_2Mn_2O_5$, $Na_2Mn_2O_5$, $CaO{\cdot}nMnO_2$ (n=0.5, 1, 2, 3, 5), $Na_3MnO_4$, $Ba_3(MnO_4)_2$, $K_2MnO_4$, $LiMnO_4$, $RbMnO_4$, $AgMnO_4$, $CsMnO_4$, $Ca(MnO_4)_2$, $Mg(MnO_4)_2$, $Ba(MnO_4)_2$, manganese oxide such as hydrate of these compounds or manganese compound such as salt thereof can be used.

Furthermore, for the main material of the degreasing solution, vanadium compound such as alkaline and ammonia vanadate, for example, $HVO_3$ (metavanadic acid), $V_2O_5$ (vanadium pentaoxide), $KVO_3$, $NaVO_3$, $Na_3VO_4$, $NH_4VO_3$, $(NH_4)_4V_4O_{12}$ and selenium compound such as $H_2SeO_4$ (selenic acid) can also be utilized.

This means that, for the main material of the degreasing solution, at least one kind selected from among a group consisting of chromium compounds, manganese compounds, vanadium compounds and selenium compounds has only to be used.

In this case, when the components of the degreasing solution are the same as those of the above-described aqueous solution for forming the oxide film, the degreasing treatment and the coloring treatment can be applied to the surface of chromium alloy in one kind of solution, and therefore another treating bath and another solution are not required to be prepared in comparison with the treatment comprising the pretreatment as exemplified in the above-described embodiment 1. Therefore, the degreasing treatment can be applied simply to the surface of the plate to be colored, and further, the coloring treatment can be applied to the surface of the plate to be colored which has undergone the degreasing treatment.

This means that the degreasing treatment in the pretreatment as exemplified in the above-described embodiment 1 is performed by immersing the plate to be colored, for example, in a solution of sodium orthosilicate family at 70° C. Furthermore, after this degreasing treatment, the plate to be colored undergoes a water rinsing treatment and a neutralizing treatment. This water rinsing treatment is performed, for example, by cleaning the plate to be colored in water using an ultrasonic cleaner. Also the neutralizing treatment is performed, for example, by immersing the plate to be colored in a solution of 20% nitric acid for 30–60 seconds. Then, after a series of these treatments, the electrolytic treatment is applied to the plate to be colored in the aqueous solution containing chromic acid and sulfuric acid, and thereby the oxide film is formed on the surface of the plate to be colored and the coloring treatment is performed. However, in such a method, in order to apply the degreasing treatment on the surface of the plate to be colored, and to further apply the degreasing treatment on the surface of the plate to be colored, in association with the degreasing treatment, not only installations such as the treating bath and the ultrasonic cleaner and chemicals such as sodium orthosilicate and nitric acid are required, but also the work thereof is very troublesome because of many processes.

On the other hand, by applying the degreasing treatment and the coloring treatment to the surface of the plate to be colored in one kind of aqueous solution, preparation for another treating bath and another solution can be dispensed with, and the degreasing treatment and the coloring treatment can be applied simply to the surface of the plate to be colored.

EXPERIMENTAL EXAMPLE

Experimental example 1

First, an aqueous solution containing chromic acid and 250 g/l and sulfuric acid of 490 g/l was prepared. Further, 19 sheets of AISI304 stainless steel plates for samples 1–19 were prepared.

Then, these stainless steel plates underwent the electrolytic treatment in the above-described aqueous solution under conditions as shown in separate table 1 to obtain the samples 1–19. In this case, $A_1$, $A_2$, $T_1$, $T_2$, N, $A_3$ and $T_3$ as shown in the separate table 1 are values as shown below, respectively.

$A_1$: Current density of anode electrolytic treatment ($A/dm^2$)

$A_2$: Current density of cathode electrolytic treatment ($A/dm^2$)

$T_1$: One-time anode electrolytic treatment time (second)

$T_2$: One-time cathode electrolytic treatment time (second)

N: Respective numbers of times of anode electrolytic treatment and cathode electrolytic treatment which are repeated alternatingly (times)

$A_3$: Current density of after cathode electrolytic treatment ($A/dm^2$)

$T_3$: After cathode electrolytic treatment time (minute)

This means that for all samples 1–19, first the anode electrolytic treatment and the cathode electrolytic treatment were performed in an alternatingly repeated manner to form an oxide film on the stainless steel plate. In this case, particularly for the samples 1–17, the anode electrolytic treatment and the cathode electrolytic treatment respectively for one or more seconds were performed with a current density of 0.05–2 ($A/dm^2$) once or more respectively in an alternatingly repeated amnner. Also, for the samples 18 and 19, the anode electrolytic treatment and the cathode electrolytic treatment were performed in an alternatingly repeated manner by a method not bound by the claims of the present invention.

Then, in this stage, for each of the samples 1–19, the color tone and the hardness of the oxide film formed on the surface thereof were studies. In this case, the color tone was studies visually for each of the samples 1–19. In addition, the sample not colored were shown by "—". Also, the hardness was studied by rubbing the surface of each of the samples 1–19 by an erasing rubber, and the samples whose rubbed portion was remarkably varied in color tone by 100 times rubbing were shown by "×" as intolerable for practical use, and the samples whose rubber portion was hardly varied in color tone by several hundreds times rubbing were shown by "O" as tolerable for practical use. The results of this experiment are shown by an evaluation 1 in the separate table 1.

The results of the experiment clearly show that the color tone of the oxide film to be formed can be varied by varying the respectively average values of current density, treating times or numbers of repetition cycles of the anode electrolytic treatment and the cathode electrolytic treatment even if the treating time $((T_1+T_2)N)$ for forming the oxide film is the same. For example, in the samples 1–4, "blue" oxide films were formed, and in the samples 5–7 , "brown" oxide films were formed. Accordingly, the above -described experimental results clearly show that the color tone of the oxide film formed on the surface of the stainless steel plate can be simply adjusted by the method in accordance with the claims of the present invention. The results further show that the formed oxide film is intolerable for practical use in the strength in this state.

Then, to the samples 1–17 whereon the oxide film was formed, the after cathode electrolytic treatment was applied in the above-described aqueous solution. In this case, the cathode electrolytic treatment was performed with a current which has an average current density larger than the average current density of the cathode electrolytic treatment when forming the oxide film and is 0.5–5A/dm$^2$.

Thus, the color tone and the hardness of the oxide film were studies for the samples 1–17 which underwent the cathode electrolytic treatment. In this case, the color tone and the hardness were studied by the same method as the above-described. Then, the results of this experiment are shown by an evaluation 2 in the separate table 1.

The results of this experiment show that the color tone is hardly varied by this cathode electrolytic treatment, also clarifying that the formed oxide film has a strength enough to be tolerable for practical use. Accordingly, it is understood that the strength of the oxide film can be improved by the cathode electrolytic treatment.

Also, for the samples 1–4 having the oxide film of the same color tone (blue), the luminosity thereof (light and dark) was studied by measuring it using the differential colormeter CR-100 manufactured by MINOLTA CAMERA CO., LTD. In this case, taking the sample 1 as a standard, the blue of the sample 2 was light, the blue of the sample 3 was dark and the blue of the sample 4 was bright. Thus, in accordance with the present invention, the luminosity and chromaticity of the oxide film to be formed can be adjusted.

Experiment 2

In this experimental example, the reproducibility of the oxide films was studies in the case where the oxide films are formed respectively on the surfaces of a plurality of stainless steel plates by the same method in accordance with the claims of the present invention.

First, five samples 2-1, 2-2, 2-3 , 2-4 and 2-5 were obtained under the same conditions as those whereunder the sample 2 of the experimental example 1 was obtained. Then, for the respective samples, respective values L, a and b were measured using the above-described differential colorimeter A separate table 2 shows the results of this experiment. Furthermore, the separate table 2 shows values $\Delta E$ when taking the sample 2-1 as a standard.

The results of this experiment shows that the values $\Delta E$ of the five samples are within 1.5, and therefore there is little difference in color among the five samples. Therefore, it is understood that a nice responsibility of color tone of the oxide film is obtainable by the method in accordance with the claims of the present invention.

Experimental example 3

In this experimental example, whether or not the color tones of the oxide films are the same was studies in the case where the oxide films were formed on the surfaces of chromium alloy by the electrolytic treatment with currents having the same average value of current density and different waveforms.

First, an aqueous solution containing chromic acid of 250 g/l and sulfuric acid of 490 g/l was prepared. Three sheets of AISI304 stainless steel plates for samples 21–23 were further prepared.

Then, the anode electrolytic treatment for 10 seconds and the cathode electrolytic treatment for 10 seconds were applied to each stainless steel plate respectively 35 times in an alternatingly repeated fashion with a current having an average current density of 0.18A/dm$^2$, and thereby the oxide film was formed on the surface of each stainless steel plate.

Figure 8A:
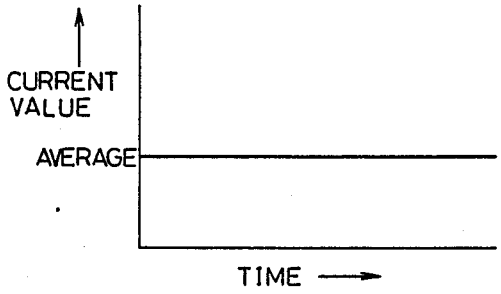
FIG. 8A through FIG. 8C are graphs showing examples of the waveforms of currents used in embodiments in accordance with the present invention, respectively.
Figure 8B:
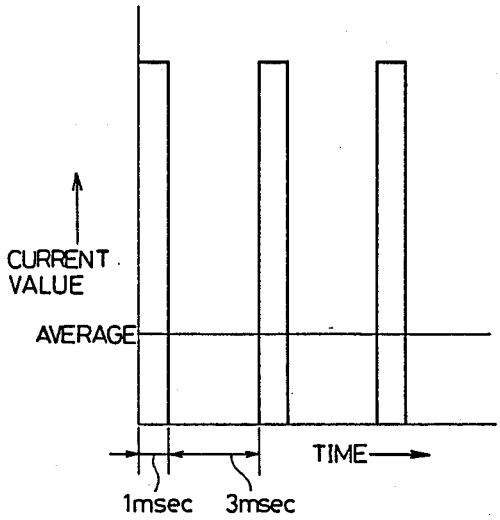
Figure 8C:
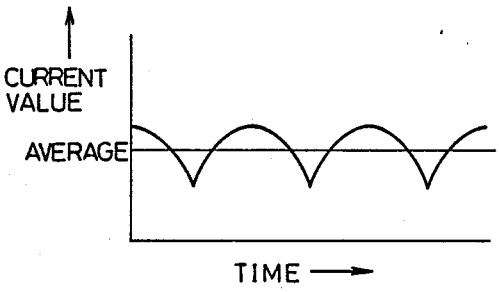

In this case, to the stainless steel plate for the sample 21, as shown in FIG. 8A, the electrolytic treatment was applied, for example, with a DC current rectified by a rectifying apparatus containing transistors. Also, to the stainless steel plate for the sample 22, as shown in FIG. 8B, the electrolytic treatment was applied with a pulse wave whose persisting time is, for example, 1 msec and whose separation time is, for example, 3 msec, that is, whose duty ratio is 1:3. Furthermore, to the stainless steel plate for the sample 23, as shown in FIG. 8C, the electrolytic treatment was applied with a pulsating current obtained, for example, by rectifying a three-phase AC current of 60 cycles, for example, by a rectifying apparatus containing thyristors.

Then, the cathode electrolytic treatment was applied to each stainless steel plates whereon the oxide film was formed for 600 seconds with a current having a current density of 1.0 A/dm$^2$ in the above-described aqueous solution to harden the oxide film, and thereby the samples 21–23 were obtained.

Then, the values L, a, and b, the color tone and the hardness of the oxide film were studies for each of the samples 21–23.

In this case, the values L, a and b were measured using the above-described differential colorimeters. Also, the color tone of each of the samples 21–23 was studied visually. Furthermore, the hardness of the oxide film was studied likewise the case of obtaining the evaluation 1 of the above-described experimental example 1. A separate table 3 shows the results of this experiment.

The results of this experiment show that if the average value of current density of a current in the electrolytic treatment for forming the oxide film is the same, the oxide film having the same color tone is formed independent of the waveform of the current.

In addition, in this experimental example 3, a pulse wave whose persisting time is 1 ms and whose separation time is 3 msec was used, but the oxide film having the same color tone was formed also by using a pulse wave whose persisting time is 0.1 msec–100 msec and whose separation time is shorter than 100 msec if the average value of the current density is the same.

EXPERIMENTAL EXAMPLE 4

In this experimental example, it was studies that how the color tone of the oxide film is varied when the conditions for forming the oxide film such as treating time and current density are varied.

First, an aqueous solution containing chromic acid of 250 g/l and sulfuric acid of 490 g/l was prepared.

(1) Oxide films were formed on the surfaces of the stainless steel plates by applying the electrolytic treatment to the stainless steel plates in this aqueous solution under respective conditions such that $A_1$ of the experimental example 1 is fixed to 0.2 A/dm$^2$, $A_2$ to 0.2 A/dm$^2$, $T_1$ to 25 sec and $T_2$ to 25 seconds respectively, and N is changed to 13, 15, 17, —, 52, 56, 68 times. Then, the values L, a and b of the respective oxide films formed under the respective conditions were measured. A separate table 4(A) shows the results of this experiment.

Figure 9:
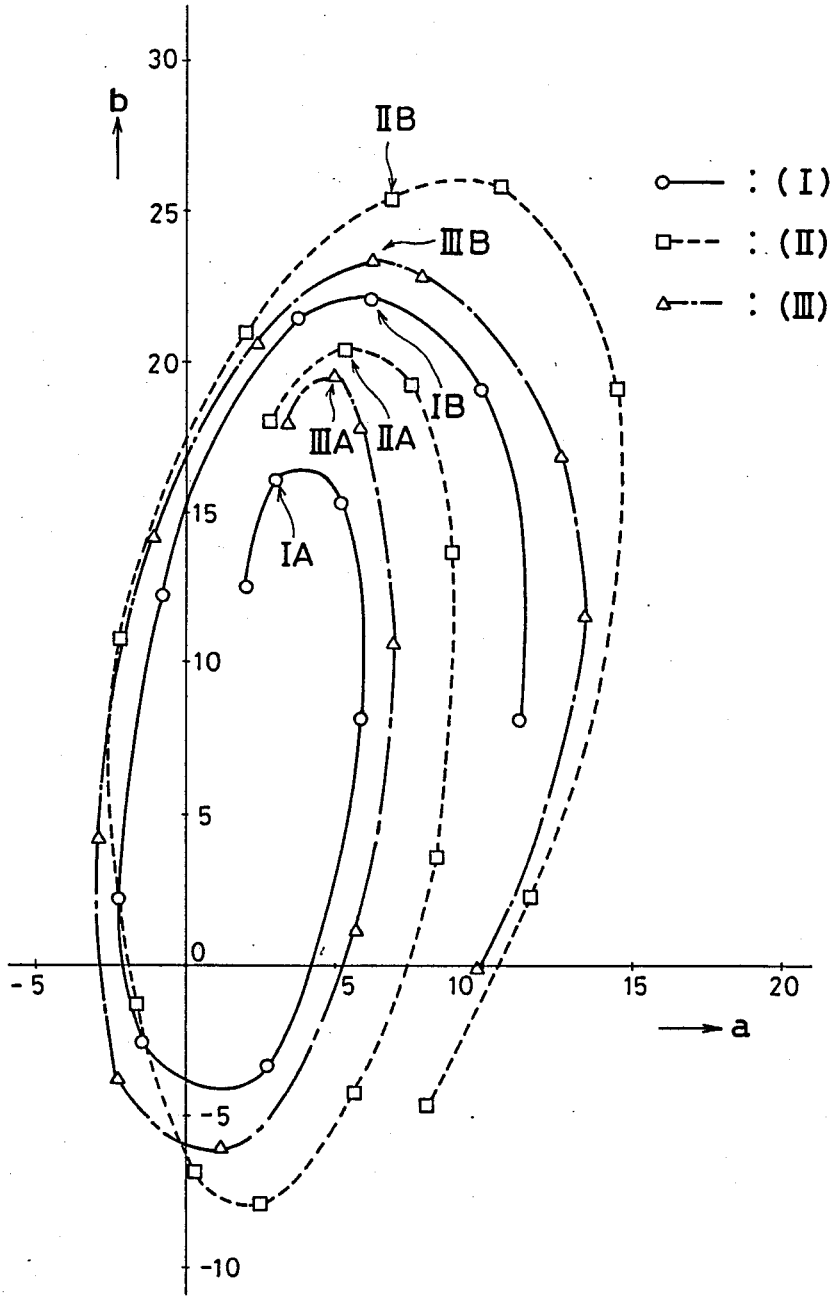
FIG. 9 is a graph showing a relationship between a value a and a value b in an experimental example 4, and the ordinate represents the value a and the abscissa represents the value b.

Also, relationships between the values a and b of the respectively oxide films are shown by (I) in a graph of FIG. 9. In this case, in the graph of FIG. 9, the abscissa represents the value a and the ordinate represents the value b.

In the graph of FIG. 9, the degree of red of the oxide film is increased with increase in the value a at the positive side, the degree of green of the oxide film is increased with increase in the value 1 at the negative side, the degree of yellow of the oxide film is increased with increase in the value b at the positive side, and the degree of blue of the oxide film is increased with increase in the value b at the negative side.

Also, a saturation c of the oxide film is expressed by $(a^2=b^2)^{\frac{1}{2}}$. Accordingly, the saturation c is represented by the distance from an origin 0 (intersection of a-axis with b-axis) to a point shown by the values a and b. This means that the oxide film becomes brighter with parting further from the origin 0.

(2) Next, as in the above-described (1), the oxide films were formed on the solution under the respective conditions such that $A_1$ is fixed to 1.0 A/dm$^2$, $A_2$ to 0.5 A/dm$^2$, $T_1$ to 1 second and $T_2$ to 1 second respectively, and N is changed to 50, 60, 70, —, 230, 270, 300 times. Then the value L, a and b of the respective oxide films were measured. A separate table 4(B) shows the results of this experiment. Also, the values a and b of the oxide films in this case are shown by (II) in the graph of FIG. 9.

(3) Furthermore, as the conventional coloring method, oxide films were formed on the surfaces of the stainless plates by immersing the stainless plates in the above-described aqueous solution of 85° C. In this case, the oxide films were formed on the surfaces of the stainless steel plates under respective conditions such that the immersing time (treating time) is changed to 3 min 30 sec, 4 min, 4 min 15 sec, —, 6 min 45 sec, 7 min and 7 min 30 sec.

Then, the cathode electrolytic treatment was applied to the stainless steel plates whereon the oxide films were formed for 7 minutes in a solution containing chromic acid of 250 g/l and phosphoric acid of 2.5 g/l with a current having a current density of 0.5 A/dm$^2$ to harden the oxide films.

Then, the values L, a and b of the respective oxide film were measured. The separate table 4 (C) shows the results of this experiment. Also, relationships between the values a and b of the oxide film in this case are shown by (III) in the graph of FIG. 9.

As is obvious from the graph of FIG. 9, as shown by (III) in the graph, only one system of color tone of the oxide film can be produced by the conventional method (3), but in accordance with the methods (1) and (2) of the experimental example 4 of the present invention, free adjustment can be made, for example, to a bright color tone as shown by (II) in the graph or to a dark color tone as shown by (I) in the graph, by varying the coloring conditions.

For example, in (I), (II) and (III) in the graph of FIG. 9, the saturation of the oxide film at each points IA, IIA, and IIIA where the color tone of the oxide film is brown is 16.42, 21.11 and 20.18 respectively, and the saturation of the oxide film at the point IIIA is brighter than that of the oxide film at the point IA, and the saturation of the oxide film at the point IIA is brighter than that of the oxide film at the points IIIA. Also, for example, in (I), (II) and (III) in the graph of FIG. 9, the saturation of the oxide film at each of the points IB, IIB and IIIB where the color tone of the oxide film is yellow is 22.92, 26.23 and 24.24 respectively, and the saturation of the oxide film at the point IIIB is brighter than that of the oxide film at the point IB, and the saturation of the oxide film at the point IIB is brighter than that of the oxide film at the point IIIB.

In addition, in (I), (II) and (III) in the graph of FIG. 9, the oxide films in the vicinity of a maximum value of the value a were red, and the oxide films in the vicinity of a maximum value of the value b were blue, respectively.

EXPERIMENTAL EXAMPLE 5

In this experimental example, it was studies that how the color tone of the oxide film is varied when a paint layer is formed on the surface of the oxide film.

In this experimental example, first the values L, a and b of the oxide film at each of the points IA, IB, IIA and IIB of the experimental example 4 were measured, The, the saturations c of the oxide films were calculated from those values a and b. A separate table 5 (A) shows the results of this calculation.

Next, the paint layer of 10 μm in thickness was formed on the surface of each of these oxide films by coating a silicone-polyester family paint. Then, the values L, a and b of the oxide films whereon the paint layers were formed were measured. Then, the saturations c of the oxide films after formation of the paint layers were calculated from these values a and b. The separate table 5(B) shows the results of this calculation.

The results of this experiment clearly show that the values L, a and b vary after the paint layer has been formed, but, for example, the relation that the saturation c of the oxide film at the point IIA is larger than that of the oxide film at the point IA and the relation that the saturation c of the oxide film at the point IIB is larger than that of the oxide film at the point IB can be maintained.

Also, the color tone of the oxide film was hardly varied even when the paint layer was formed on the surface of the oxide film. This means that before and after formation of the paint layer, the oxide film at the point IA was dark brown, the oxide film at the point IIB was dark yellow, the oxide film at the point IIA was bright brown, and the oxide film at the point IIB was bright yellow.

In addition, the color tone of the oxide film was hardly changed even when the paint layer was formed in a thickness of, for example, 5 μm or 20 μm. Also, the wear resistance of the oxide film was improved by forming the paint layer on the surface of the oxide film.

EXPERIMENTAL EXAMPLE 6

In this experiment, it was studies that how the time for forming the oxide film varies when metal ions of metal, for example, Ni, Mo or Mg are further contained in the aqueous solution for forming the oxide film and the like.

In this experimental example, first an aqueous solution containing chromic acid of 250 g/l and sulfuric acid of 490 g/l was prepared.

Then, the electrolytic treatment was applied to the stainless steel plates under the conditions that $A_1$ of the experimental example 1 is set to 0.2 A/dm$^2$, $A_2$ to 0.3 A/dm$^2$, $T_1$ to 15 sec and $T_2$ to 5 sec respectively, and thereby a yellow oxide film was formed on the surface thereof. In this case, N was 37 times.

Next, the electrolytic treatment was applied to the stainless steel plate in the aqueous solution containing chromic acid of 250 g/l and sulfuric acid of 490 g/l whereto $Ni^{2+}$ of 20 g/l was added under the conditions that $A_1$ is set to 0.2 A/dm$^2$, $A_2$ to 0.3 A/dm$^2$, $T_1$ to 15 sec and $T_2$ to 5 sec respectively, and thereby a yellow oxide film was formed on the surface thereof. In this case, N was 31 times.

Furthermore, the electrolytic treatment was applied to the stainless steel plate in the aqueous solution containing chromic acid of 250 g/l and sulfuric acid of 490 g/l whereto $Mo^{6+}$ of 20 g/l was added under the conditions that $A_1$ was set to 0.2 A/dm$^2$, $A_2$ to 0.3 A/dm$^2$, $T_1$ to 15 sec and $T_2$ to 5 sec respectively, and thereby a yellow oxide film was formed on the surface thereof. In this case, N was 32 times.

The results of this experiment clearly show that addition of metal ions $Ni^{2+}$ or $Mo^{6+}$ to the solution for forming the oxide film can reduce the time taken for forming the oxide film.

EXPERIMENTAL EXAMPLE 7

In this experimental example, first, an aqueous solution containing chromic acid of 250 g/l and sulfuric acid of 490 g/l was prepared.

Then, in this aqueous solution, the oxide films were formed on the stainless steel plates under the conditions as shown in a separate table 6, and further the cathode electrolytic treatment was applied to the stainless steel plates whereon the oxide films were formed, and thereby samples 31–53 were obtained.

In this case, for sample 31, the oxide film was formed by repeating 10 times the anode electrolytic treatment and the cathode electrolytic treatment respectively for 60 sec (120 sec in all ) alternatingly with a current having an average current density of 0.2 A/dm$^2$, and thereby the oxide film was formed. To the samples 32–53, likewise the above, the anode electrolytic treatment and the cathode electrolytic treatment were applied in an alternatingly repeated manner, and thereby the oxide films were formed. Furthermore, after formation of the oxide film, the cathode electrolytic treatment was applied to the samples 31–34, 50 and 51 with a current having an average current density of 0.4 A/dm$^2$ or less, and to the samples 35–49, 52 and 53 with a current which has an average current density larger than the average current density of the cathode electrolytic treatment in forming the oxide film and is 0.5–5 A/dm$^2$, respectively.

For the samples 31–53 thus obtained, the color tone and the hardness of the oxide film were studied. These color tone and hardness were studies likewise the case of the above-described experimental example 1. An evaluation 3 in the separate table 6 shows the results of this experiment.

The results of this experiment clearly show that if the conditions for forming the oxide film are constant, the oxide films having the same color tone are formed. Furthermore, these results show that when the cathode electrolytic treatment is performed with a current which has an average current density larger than that in the cathode electrolytic treatment in forming the oxide film and is 0.5–5 A/dm$^2$, the oxide film is hardened.

EXPERIMENTAL EXAMPLE 8

First, two sheets of stainless steel plates of 150 mm in longitudinal length, 140 mm in lateral length and 1.5 mm in thickness were prepared as the plates 20 to be colored for applying the degreasing treatment and the coloring treatment to the surface thereof. Then, in order to make sure, whether or not oil, grease or the like adheres to the surface of each plates 20 to be colored for a sample, each plate 20 to be colored was placed so that the surface thereof is horizontal, and water was poured uniformly on the surface thereof. Then, on the surfaces of these plates 20 to be colored, water gathered here and there in a lump. This showed the adhesion of oil or grease to the surfaces of these plate 20 to be colored.

Furthermore, the lead counter electrode plate 22 of 150 mm in longitudinal length and 140 mm in lateral length was prepared.

On the other hand, a degreasing solution 40 containing chromic acid of 250 g/l and sulfuric acid of 490 g/l was prepared, and this degreasing solution 40 was poured into a beaker 42 containing 5 l as a bath.

Figure 10:
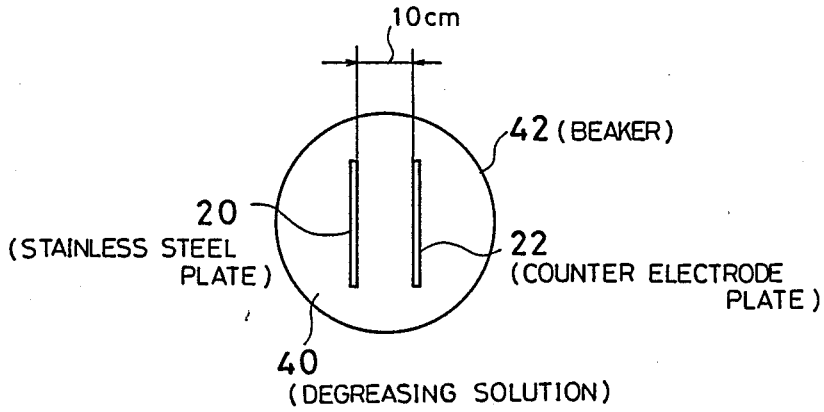
FIG. 10 is an illustrative view showing a positional relationship between the plate to be colored and a counter electrode plate in an experimental example 8.

Then, as shown in FIG. 10, the counter electrode plate 22 was disposed in the beaker 42 wherein the degreasing solution 40 was poured so as to face the plate 20 to be colored with an interval of 10 cm kept.

Then, the cathode electrolyte treatment was applied to each of the plates 20 to be colored for a sample in a manner that a current having a current density 0.5 A/dm$^2$ is carried to each plate 20 for 180 sec or 300 sec respectively, and thereby the degreasing treatment was performed.

Here, in order to make sure that the degreasing treatment was applied to the surface of each plate 20 to be colored for a sample, each plate 20 to be colored was pulled up from the degreasing solution 40, and was placed so that the surface thereof is horizontal, and water was poured on the surface thereof. Then, on the surface of each plate 20 to be colored whereto this cathode electrolytic treatment was applied, water was present in a uniform thin layer. Accordingly, it was made sure that the degreasing treatment was applied to the surface of the plate 20 to be colored by this cathode electrolytic treatment.

In addition, in each embodiment and each experimental example, as described above, the treatments were applied to plate-shaped chromium alloy, but the present invention is applicable also to chromium alloy of any shape, for example, wire shape, pipe share or coil shape.

Although the present invention has been described and illustrated in detail, it is clearly understood that the same is by way of illustration and example only and is not to be taken by way of limitation, the spirit and scope of the present invention being limited only by the terms of the appended claims.

TABLE 1

| Sample | Treatment for forming oxide film | | | | | Evaluation 1 | | After cathode electrolytic treatment | | Evaluation 2 | |
|---|---|---|---|---|---|---|---|---|---|---|---|
| | $A_1$ | $A_2$ | $T_1$ | $T_2$ | N | Color | Hardness | $A_3$ | $T_3$ | Color | Hardness |
| 1 | 0.25 | 0.2 | 35 | 40 | 12 | Blue | X | 1.5 | 10 | Blue | O |
| 2 | 0.17 | 0.18 | 200 | 100 | 3 | Blue | X | 1.5 | 10 | Blue | O |
| 3 | 0.2 | 0.2 | 90 | 90 | 5 | Blue | X | 1.5 | 10 | Blue | O |
| 4 | 0.2 | 0.2 | 85 | 65 | 6 | Blue | X | 1.5 | 10 | Blue | O |
| 5 | 0.06 | 0.2 | 100 | 80 | 5 | Brown | X | 1.5 | 10 | Brown | O |
| 6 | 0.1 | 0.3 | 45 | 45 | 10 | Brown | X | 1.5 | 10 | Brown | O |
| 7 | 0.2 | 0.2 | 25 | 35 | 15 | Brown | X | 1.5 | 10 | Brown | O |
| 8 | 0.15 | 0.2 | 23 | 27 | 18 | Black | X | 1.5 | 10 | Black | O |
| 9 | 0.13 | 0.3 | 400 | 300 | 1 | Yellow | X | 1.5 | 10 | Yellow | O |
| 10 | 0.05 | 0.05 | 100 | 10 | 100 | Yellow | X | 2.0 | 1 | Yellow | O |
| 11 | 0.05 | 0.05 | 100 | 10 | 100 | Yellow | X | 2.0 | 60 | Yellow | O |
| 12 | 2.0 | 2.0 | 2 | 20 | 100 | Yellowish green | X | 4.5 | 8.3 | Yellowish green | O |
| 13 | 2.0 | 2.0 | 2 | 20 | 100 | Yellowish green | X | 4.5 | 500 | Yellowish green | O |
| 14 | 1.0 | 0.5 | 1 | 1 | 300 | Purple | X | 2.5 | 17.5 | Purple | O |
| 15 | 1.0 | 0.5 | 1 | 1 | 300 | Purple | X | 2.5 | 1050 | Purple | O |
| 16 | 0.5 | 0.3 | 500 | 500 | 2 | Red | X | 3.0 | 10 | Red | O |
| 17 | 0.5 | 0.3 | 500 | 500 | 2 | Red | X | 3.0 | 600 | Red | O |
| 18 | 0.03 | 0.5 | 10 | 10 | 50 | — | X | | | | |
| 19 | 0.1 | 0.2 | 0.5 | 0.5 | 750 | — | X | | | | |

TABLE 2

| Sample | L | a | b | ΔE |
|---|---|---|---|---|
| 2-1 | 46.0 | −2.0 | −3.0 | |
| 2-2 | 46.5 | −2.2 | −3.3 | 0.6 |
| 2-3 | 45.2 | −2.8 | −4.0 | 1.5 |
| 2-4 | 47.1 | −1.5 | −2.3 | 1.4 |
| 2-5 | 45.8 | −2.0 | −3.8 | 0.4 |

TABLE 3

| Sample | L | a | b | Tone of color | Hardness |
|---|---|---|---|---|---|
| 21 | 46.47 | +2.38 | +8.57 | Dark Brown | O |
| 22 | 44.95 | +2.03 | +7.46 | Dark Brown | O |
| 23 | 45.97 | +2.55 | +8.35 | Dark Brown | O |

TABLE 4 (A)

| N | L | a | b |
|---|---|---|---|
| 13 | 63.60 | +2.09 | +12.51 |
| 15 | 53.54 | +3.02 | +16.14 |
| 17 | 44.07 | +5.19 | +15.38 |
| 20 | 35.79 | +5.87 | +8.21 |
| 26 | 32.53 | +2.78 | −3.29 |
| 31 | 37.15 | −1.41 | −2.46 |
| 35 | 43.71 | −2.22 | +2.21 |
| 40 | 46.58 | −0.74 | +12.23 |
| 47 | 45.98 | +3.77 | +21.44 |
| 52 | 45.52 | +6.19 | +22.07 |
| 56 | 43.13 | +9.90 | +19.11 |
| 68 | 41.05 | +11.21 | +8.09 |

TABLE 4 (B)

| N | L | a | b |
|---|---|---|---|
| 50 | 51.64 | +2.80 | +18.03 |
| 60 | 45.54 | +5.26 | +20.44 |
| 70 | 43.21 | +7.57 | +19.31 |
| 80 | 36.70 | +8.89 | +13.74 |
| 90 | 32.42 | +8.35 | +3.59 |
| 100 | 32.01 | +5.63 | −4.27 |
| 110 | 34.34 | +2.54 | −7.91 |
| 130 | 38.32 | +0.24 | −6.81 |
| 140 | 42.67 | −1.62 | −1.18 |
| 160 | 51.69 | −2.21 | +10.83 |
| 180 | 53.88 | +2.00 | +21.02 |

TABLE 4 (B)-continued

| N | L | a | b |
|---|---|---|---|
| 200 | 54.09 | +6.80 | +25.33 |
| 210 | 50.51 | +10.53 | +25.79 |
| 230 | 45.36 | +14.43 | +19.20 |
| 270 | 42.84 | +11.58 | +2.29 |
| 300 | 40.18 | +8.06 | −4.61 |

TABLE 4 (C)

| Treating time ' (min.) " (sec.) | L | a | b |
|---|---|---|---|
| 3'30" | 57.40 | +3.46 | +18.04 |
| 4'00" | 49.16 | +4.94 | +19.57 |
| 4'15" | 43.11 | +5.82 | +17.91 |
| 4'30" | 35.41 | +6.97 | +10.63 |
| 4'45" | 31.28 | +5.74 | +1.18 |
| 5'00" | 31.70 | +1.19 | −5.98 |
| 5'15" | 37.57 | −2.29 | −3.70 |
| 5'30" | 43.39 | −2.83 | +4.20 |
| 5'45" | 46.48 | −1.02 | +14.23 |
| 6'00" | 47.02 | +2.41 | +20.64 |
| 6'15" | 46.73 | +6.27 | +23.41 |
| 6'30" | 43.20 | +7.89 | +22.94 |
| 6'45" | 39.98 | +12.61 | +16.93 |
| 7'00" | 36.94 | +13.38 | +11.55 |
| 7'30" | 34.38 | +9.81 | −0.06 |

TABLE 5 (A)

| Oxide film | L | a | b | c |
|---|---|---|---|---|
| I A | 53.54 | +3.02 | +16.14 | 16.42 |
| I B | 45.52 | +6.19 | +22.07 | 22.92 |
| II A | 45.54 | +5.26 | +20.44 | 21.11 |
| II B | 54.09 | +6.80 | +25.33 | 26.23 |

TABLE 5 (B)

| Oxide film | L | a | b | c |
|---|---|---|---|---|
| I A | 49.69 | +2.03 | +10.96 | 11.15 |
| I B | 40.35 | +3.27 | +16.84 | 17.15 |
| II A | 48.77 | +3.06 | +13.67 | 14.01 |
| II B | 43.52 | +3.90 | +19.22 | 19.62 |

TABLE 6

| Sample | Treatment for forming oxide film Current density (A/dm²) | Treating time (sec) | Treatment for hardening oxide film Current density (A/dm²) | Treating time (sec) | Evaluation 3 Color | Hardness |
|---|---|---|---|---|---|---|
| 31 | 0.2 | 120 × 10 | 0.1 | 500 | Blue | X |
| 32 | 0.2 | 120 × 10 | 0.2 | 500 | Blue | X |
| 33 | 0.2 | 120 × 10 | 0.3 | 500 | Blue | X |
| 34 | 0.2 | 120 × 10 | 0.4 | 500 | Blue | X |
| 35 | 0.2 | 120 × 10 | 0.5 | 500 | Blue | O |
| 36 | 0.2 | 120 × 10 | 0.6 | 500 | Blue | O |
| 37 | 0.2 | 120 × 10 | 0.8 | 180 | Blue | O |
| 38 | 0.2 | 120 × 10 | 0.8 | 300 | Blue | O |
| 39 | 0.2 | 120 × 10 | 0.8 | 900 | Blue | O |
| 40 | 0.2 | 120 × 10 | 0.8 | 1200 | Blue | O |
| 41 | 0.2 | 120 × 10 | 1.0 | 600 | Blue | O |
| 42 | 0.2 | 120 × 10 | 1.5 | 600 | Blue | O |
| 43 | 0.2 | 120 × 10 | 2.0 | 500 | Blue | O |
| 44 | 0.2 | 120 × 10 | 3.0 | 500 | Blue | O |
| 45 | 0.1 | 60 × 20 | 2.0 | 450 | Blue | O |
| 46 | 0.15 | 100 × 100 | 0.8 | 420 | Yellow | O |
| 47 | 0.15 | 1000 × 1 | 0.8 | 420 | Yellow | O |
| 48 | 0.3 | 40 × 20 | 1.5 | 440 | Brown | O |
| 49 | 0.4 | 10 × 60 | 2.0 | 600 | Violet | O |
| 50 | 0.2 | 120 × 9.5 | 0.1 | 500 | Blue | X |
| 51 | 0.2 | 120 × 9.5 | 0.3 | 500 | Blue | X |
| 52 | 0.2 | 120 × 9.5 | 0.8 | 500 | Blue | O |
| 53 | 0.2 | 120 × 9.5 | 3.0 | 500 | Blue | O |

What is claimed is:

1. An electrolytic coloring method for chromium alloy which colors chromium alloy by applying an electrolytic treatment to said chromium alloy, comprising the following steps:

inserting chromium alloy into an aqueous solution containing a chromium compound as a main material and sulfuric acid, forming an oxide film on the surface of said chromium alloy by alternately applying an anode electrolytic treatment and a cathode electrolytic treatment respectively for one or more seconds with a current having an average current density of 0.05–2 A/dm² respectively one or more times and, hardening the oxide film on the surface of said chromium alloy by an electrolytic treatment to said chromium alloy, having a current which has an average current density larger than the average current density of said cathode electrolytic treatment in said step for forming said oxide film and which is 0.5–5 A/dm², wherein the step of forming said oxide film on the surface of said chromium alloy adjusts the color tone of said oxide film by varying respective average current densities, respective treating times and the number of repetition cycles of said anode electrolytic treatment and of said electrolytic cathode treatment.

2. an electrolytic coloring method for chronium alloy in accordance with claim 1, in which said chronium compound is a member of the group consisting of chromic acid, chromate and bichromate acid.

3. An electrolytic coloring method for chromium alloy in accordance with claim 1, further comprising the step of forming a paint layer, on the surface of said oxide film.

4. An electrolytic coloring method for chromium alloy in accordance with claim 3, wherein said step of forming said paint layer includes the step of coating an organic family paint on the surface of said oxide films.

5. An electrolytic coloring method for chromium alloy in accordance with claim 3, wherein said step of forming said paint layer includes the step of coating an inorganic family paint on the surface of said oxide film.

6. An electrolytic coloring method for chromium alloy in accordance with claim 3, wherein said step of forming said paint layer includes the step of coating a metal alkoxide solution on the surface of said oxide film.

7. An electrolytic coloring method for chromium alloy in accordance with claim 1, further comprising the step of preparing a degreasing solution which contains at least one member selected from among a group consisting of chromium compound, manganese compound, vanadium compound and selenium compound as a main material and contains sulfuric acid, and the step of applying a cathode electrolytic treatment to said chromium alloy in said degreasing solution to apply a degreasing treatment to the surface of said chromium alloy.

8. An electrolytic coloring method for chromium alloy in accordance with claim 7, wherein said chromium compound contained in said degreasing solution is a member selected from the group consisting of chromic acid, chromate and bichromic acid.

9. An electrolytic coloring method for chromium alloy in accordance with claim 7, wherein said manganese compound comprises manganese oxide or manganate.

10. An electrolytic coloring method for chromium alloy in accordance with claim 9, wherein said managanese oxide and manganate is a member selected from the group consisting of potassium permanganate, sodium permaganate, manganese dioxide and manganese sulfate.

11. An electrolytic coloring method for chromium alloy in accordance with claim 7, wherein said vanadium compound comprises vanadate.

12. An electrolytic coloring method for chromium alloy in accordance with claim 11, wherein said vanadate is a member selected from the group consisting of metavanadic acid and vanadium pentaoxide.

13. An electrolytic coloring method for chromium alloy in accordance with claim 7, wherein said selenic compound comprises selemium acid.

14. An electrolytic coloring method for chromium alloy in accordance with claim 7, wherein said step of preparing said degreasing solution includes the step of preparing the same solution as said aqueous solution.

15. An electrolytic coloring method for chromium alloy in accordance with claim 1, in which the aqueous solution contains chromic acid in a concentration within the range of 50 to 500 g/l.

16. An electrolytic coloring method for chromium alloy in accordance with claim 1, in which the aqueous solution contains sulfuric acid in a concentration within the range of 300 to 1000 g/l.

17. An electrolytic coloring method for chromium alloy in accordance with claim 1, in which the aqueous solution contains chromic acid in a concentration within the range of 200–400 g/l and sulfuric acid in a concentration within the range of 400–600 g/l.

18. An electrolytic coloring method for chromium alloy in accordance with claim 1, in which the aqueous solution contains a metal ion is a member selected from the group consisting of Cr, Mn, Mo, Mg, Ni, Sn, Co, V, Ti, Al, B, W, Ir, and Zr.

19. An electrolytic coloring method for chromium alloy in accordance with claim 18, in which the metal ion is $Ni^{2+}$ or $Mo^{6+}$.

20. An electrolytic coloring method for chromium alloy in accordance with claim 1, in which the color produced is blue.

21. An electrolytic coloring method for chromium alloy in accordance with claim 1, in which the color produced is brown.

22. An electrolytic coloring method for chromium alloy in accordance with claim 1, in which the color produced is black.

23. An electrolytic coloring method for chromium alloy in accordance with claim 1, in which the color produced is yellow.

24. An electrolytic coloring method for chromium alloy in accordance with claim 1, in which the color produced is yellowish green.

25. An electrolytic coloring method for chromium alloy in accordance with claim 1, in which the color produced is purple.

26. An electrolytic coloring method for chromium alloy in accordance with claim 1, in which the color produced is red.

* * * * *